United States Patent [19]

Fry

[11] Patent Number: 4,738,214

[45] Date of Patent: Apr. 19, 1988

[54] MOORING DEVICE

[76] Inventor: Jewell C. Fry, Rte. 3, Box 4116, Osage Beach, Mo. 65065

[21] Appl. No.: 17,743

[22] Filed: Feb. 24, 1987

[51] Int. Cl.[4] ..... B63B 21/08

[52] U.S. Cl. ..... 114/218; 24/115 K; 24/236; 24/237

[58] Field of Search ..... 114/199, 218, 230; 24/231, 236, 237, 115 K

[56] References Cited

U.S. PATENT DOCUMENTS

| | | | |
|---|---|---|---|
| 456,743 | 7/1891 | Soule | 24/546 |
| 652,905 | 7/1900 | Swales | 24/230.5 |
| 805,646 | 11/1905 | Hubbard | 24/236 |
| 1,281,336 | 10/1918 | Frazier, Jr. . | |
| 2,764,792 | 10/1956 | Mansfield | 24/73 |
| 2,861,535 | 11/1958 | Hutchison et al. | 114/218 |
| 3,055,333 | 9/1962 | Ryan | 114/210 |
| 3,131,452 | 5/1964 | Marino | 24/230.5 |
| 3,193,318 | 7/1965 | Guerrant, Jr. | 294/83 |
| 3,465,391 | 9/1969 | Armstrong | 114/218 X |
| 3,763,815 | 10/1973 | Hodate | 114/230 |
| 3,813,122 | 5/1974 | Wemyss | 294/19 R |
| 3,879,812 | 4/1975 | Clinch | 24/230.5 |
| 4,055,137 | 10/1977 | Motai et al. | 114/230 |
| 4,061,873 | 12/1977 | Berg, Jr. et al. | 24/237 X |
| 4,143,613 | 3/1979 | Paul | 114/230 |
| 4,231,140 | 11/1980 | Ebreo et al. | 24/237 |
| 4,560,098 | 12/1985 | Tupper | 226/92 |

*Primary Examiner*—Sherman D. Basinger

*Attorney, Agent, or Firm*—Senniger, Powers, Leavitt and Roedel

[57] ABSTRACT

A mooring device comprising a base adapted to be fastened to a surface of a dock or boat deck for mooring a boat. An arm extends up from the base generally adjacent one end of the base and converges toward the opposite end of the base thereby to define, in conjunction with the base, a space for retaining a mooring line. The arm converges toward the base to a point where it is relatively closely spaced to the base thereby to form a mouth through which a mooring line may be passed inwardly into the line-retaining space. A finger is provided on the arm adjacent the mouth inclined downwardly and inwardly toward the line-retaining space. The arm is spring biased from an open position in which the mouth is relatively wide open and the finger is spaced from the base a distance sufficient to permit passage of a mooring line inwardly through the mouth between the retaining member and the base into the line-retaining space, toward a closed position in which the mouth is relatively closed and the finger is spaced from the base a distance less than the diameter of the line for blocking passage of the mooring line outwardly through the mouth.

18 Claims, 2 Drawing Sheets

FIG. 1
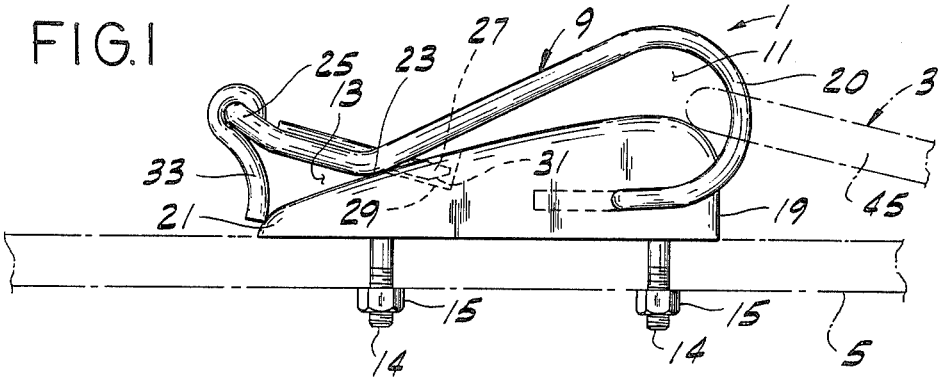
FIG. 2
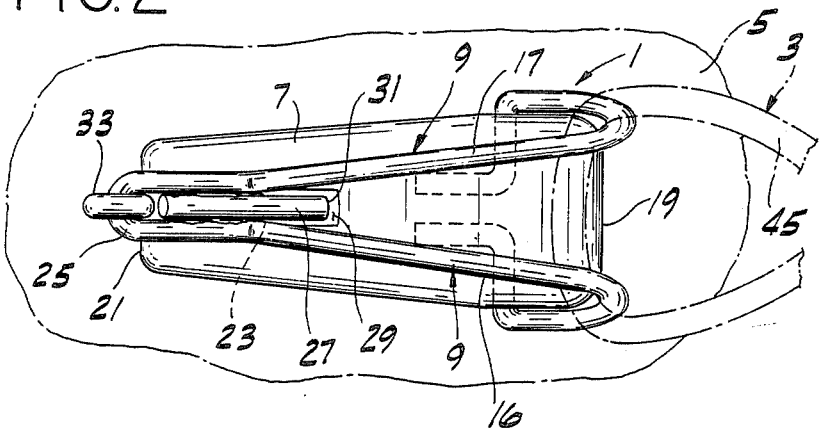
FIG. 5
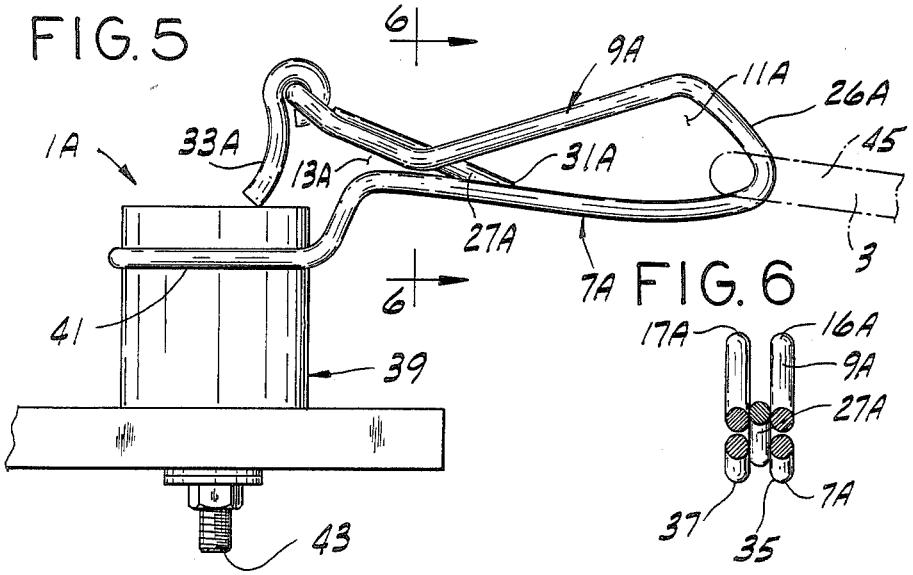
FIG. 6

MOORING DEVICE

BACKGROUND OF THE INVENTION

This invention relates generally to mooring devices, and more particularly to such a device for quickly mooring a boat to a dock.

Heretofore, small boats have generally been moored to docks by mooring lines, and this has presented certain problems. For example, excess portions of such mooring lines are typically left in large piles on the dock, where they are likely to become entangled with a person's feet. Moreover, when the mooring lines are tied by inexperienced boaters, "granny knots" are frequently used and this type of knot tends to loosen, thereby allowing the boat to slip away from the dock. As a result, there is a need for a device for conveniently and securely mooring small recreational boats to a dock.

Various mooring devices have been developed for mooring large boats to a dock. For example, U.S. Pat. No. 4,143,613 discloses docking apparatus designed to allow the operator of a boat to secure the boat to a dock without leaving the controls of the boat. A hooked arm extending from the side of the boat is provided to snag and hold a mooring line suspended from a post on the dock. U.S. Pat. No. 2,764,792 discloses a "pelican type mooring hook" attached to one end of a mooring line, the hook having a spring-operated closure member for securing the hook to a mooring ring on a bouy. U.S. Pat. Nos. 3,813,122; 3,763,815; and 1,281,336 also disclose mooring devices.

SUMMARY OF THE INVENTION

Among the several objects of the invention may be noted the provision of a mooring device for quickly and securely mooring a boat to a dock; the provision of such a mooring device which facilitates easy and quick disconnection of mooring lines; the provision of such a mooring device which is adapted to retain the looped end of a mooring line; the provision of such a mooring device which avoids piling excess mooring line on a dock or boat thereby to keep the dock and/or boat neat; and the provision of such a mooring device which is durable and inexpensive.

Generally, a mooring device of the present invention comprises a base and means for fastening the base to a surface, such as the surface of a dock or boat deck. An arm is provided extending up from the base generally adjacent one end of the base and converging toward the opposite end of the base thereby to define, in conjunction with the base, a space for retaining a mooring line. The arm converges toward the base to a point where it is relatively closely spaced to the base thereby to form a mouth through which a mooring line may be passed inwardly into the line-retaining space. A finger is provided on the arm adjacent the mouth inclined downwardly and inwardly toward the line-retaining space. The arm is spring biased from an open position in which the mouth is relatively wide open and the finger is spaced from the base a distance sufficient to permit passage of a mooring line inwardly through the mouth between the retaining member and the base into the line-retaining space, toward a closed position in which the mouth is relatively closed and the finger is spaced from the base a distance less than the diameter of the line for blocking passage of the mooring line outwardly through the mouth.

Other objects and features will be in part apparent and in part pointed out hereinafter.

BRIEF DESCRIPTION OF THE DRAWINGS

FIG. 1 is a side elevation of a mooring device of the present invention;

FIG. 2 is a top plan of the mooring device of FIG. 1;

FIG. 5 is a view similar to FIG. 1 showing another embodiment of the mooring device; and FIG. 6 is a cross-sectional view taken along line 6—6 of FIG. 5.

Corresponding reference characters indicate corresponding parts throughout the several views of the drawings.

DESCRIPTION OF PREFERRED EMBODIMENTS

Figure 3:
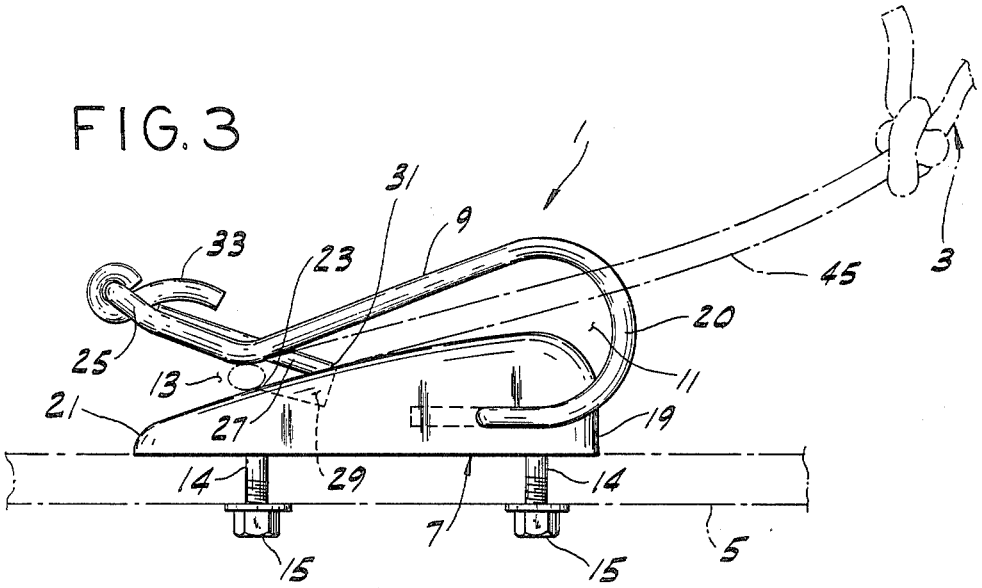
FIG. 3 is a side elevation similar to FIG. 1 showing an arm of the mooring device in its open position.
Figure 4:
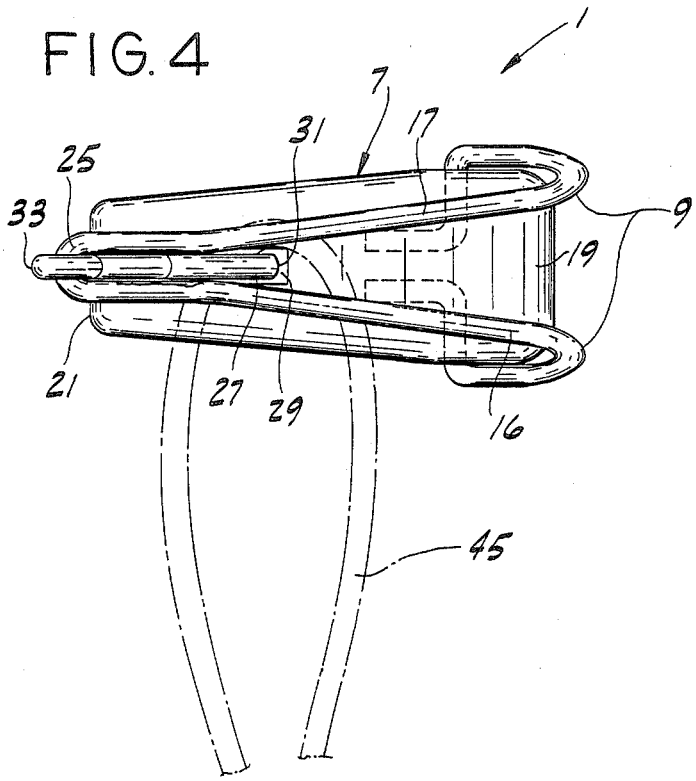
FIG. 4 is a view similar to FIG. 2 illustrating how a mooring line is removed from the mooring device of FIGS. 1–3.

Referring now to the drawings, a mooring device of the present invention is designated in its entirety by the reference numeral 1. Mooring device 1 is especially adapted for holding a mooring line 3 (shown in phantom) to secure a boat (not shown) to a surface, such as the surface 5 of a dock or boat deck.

As shown in FIG. 1, the mooring device 1 generally comprises a base or body member 7 and a spring arm generally indicated at 9. The arm 9 is formed of resilient metal wire bent to form, in conjunction with the base 7, a line-retaining space 11 and a mouth 13 through which mooring line 3 may be passed inwardly into the line-retaining space. "Inwardly" and "outwardly" are herein defined with respect to line-retaining space 11, e.g., pulled inwardly means pulled into the line-retaining space. Means, such as threaded studs 14 and nuts 15, is provided for fastening the base 7 to surface 5.

More specifically, the arm 9 comprises two generally J-shaped arm members 16 and 17 (e.g., of bent metal wire) extending laterally outwardly from opposite sides of the base 7 adjacent one end 19 of the base (the right end as viewed in FIGS. 1 and 2). The arm members 16 and 17 are bent toward the right end 19 of the base and then upwardly from the base to form smoothly curving bights 20 at the right end of the line-retaining space 11. From the upper ends of respective bights 20, the arm portions 16 and 17 extend or converge toward the opposite (left) end 21 of the base 7 to a point 23 where they are relatively closely spaced to the base to form mouth 13. The arm members 16 and 17 also converge toward each other in the direction away from the bights 20 until at the mouth 13, they are spaced apart a distance approximately equal to the width or diameter of one arm member. An outer free end portion 25 of the arm 9 flares upwardly and outwardly from the mouth 13 for guiding the line 3 into the mouth.

Finger means comprising a finger 27 is provided on the arm 9 adjacent the mouth 13. Finger 27 is inclined downwardly and inwardly toward the line-retaining space 11 and is received in a recess 29 formed in the base 7 adjacent the left end 21 of the base to prevent mooring line 3 from being pulled outwardly from the line retaining space. The finger 15 may be formed of metal wire similar to that of the arm 9. Preferably, the finger 15 is attached to the outer free end portion 25 of the arm 9 between arm members 16 and 17, the finger 15 extending toward the base 7 in a plane generally parallel to the outer free end portion of the arm. The free end 31 of the finger 15 may be configured to facilitate pulling the mooring line 3 inwardly past the finger, as by, for example, being cut or bevelled at a diagonal to the central longitudinal axis of the finger, as shown in the drawings.

The arm 9 is spring-biased toward a closed position (FIG. 1) in which the mouth 13 is relatively closed and the finger 27 is received in recess 29 in the base 7 for blocking passage of the mooring line 3 outwardly through the mouth. The arm 9 is movable against the spring bias from the closed position to an open position (FIG. 3) in which the mouth 13 is relatively wide open and the finger 27 is spaced a distance from the base 7 sufficient to permit passage of a mooring line 3 inwardly through the mouth between the finger and the base into the line-retaining space 11. It will be understood that, in order to block passage of the mooring line 3 when the arm is in the closed position, the finger 27 must be spaced from the base 7 a distance less than the diameter of the line. Thus, while recess 29 provides additional security, it is not essential to the operation of the invention.

Preferably, a safety member 33 is provided to prevent a mooring line from being inadvertently pulled inwardly into the line-retaining space 11. The safety member 33 is pivotably connected to the outer free end portion 25 of the arm 9, and is pivotable from a closed position (FIG. 1) wherein it blocks passage of a line inwardly through the mouth 13, to an open position (FIG. 3) to permit passage of the line 3 inwardly through the mouth.

FIGS. 5 and 6 illustrate a second embodiment of the mooring device, generally designated 1A. This device generally corresponds to the device shown in FIGS. 1–4, the principal differences being that the base, here designated 7A, comprises two generally parallel spaced-apart legs 35 and 37 (e.g., of metal wire) integrally formed with one another and mounted on a cylindrical member 39. The arm 9A comprises two generally parallel spaced-apart arm members 16A and 17A integrally formed with the legs 35 and 37 and extending upwardly from the legs to form bights 20A at the right end of the line-retaining space 11A. Finger 27A has a free end 31A adapted to be received in the space between the legs 35 and 37 when the arm is in its closed position. The finger 27A is formed of metal wire having a diameter slighlty less than the space between the legs 35 and 37. A circular portion 41 of the legs 35 and 37 is received in a circumferential groove in the cylindrical member 39 to securely fasten the base 7A to the cylindrical member. The cylindrical member 35 has an coaxial bore (not shown) for receiving a bolt 43 to fasten the mooring device 1A to surface 5A.

Before attaching the mooring line 3 to the mooring device 1 or 1A, a loop 45 is formed at the end of the line for connection to the device. Then, to attach the mooring line 3 to the mooring device 1, the safety member 33 is pivoted to its open position (FIG. 3), and loop 45 is pulled inwardly through mouth 13, 13A into the line-retaining space 11, 11A (see FIG. 2). The safety member 33, 33A is then pivoted to its closed position (FIG. 1) to prevent the loop 45 from accidentally disengaging itself from the device, it being understood that if the loop were to be again pulled inwardly through the mouth 13, 13A, the loop would release itself from the mooring device (e.g., see FIG. 4). To remove the line 3 from the mooring device, the safety member 33, 33A is pivoted to its open position (FIGS. 3 and 4), and a portion of the loop 45 is then pulled inwardly through the mouth 13, 13A to release the line from the mooring device.

It will be observed that, in addition to mooring small and large boats, the mooring device 1 has many other potential applications where a line must be quickly and securely attached to a surface.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mooring device comprising a base, means for fastening the base to a surface, such as the surface of a dock or boat deck, and an arm on the base extending up form the base generally adjacent one end of the base and converging toward the opposite end of the base thereby to define, in conjunction with the base, a space for retaining a mooring line, said arm converging toward the base to a point where it is relatively closely spaced to the base thereby to form a mouth through which mooring line may be passed inwardly into said line-retaining space, finger means on the arm adjacent said mouth inclined downwardly and inwardly toward said line-retaining space, said arm being spring biased from an open position in which said mouth is relatively wide open and said finger means is spaced from the base a distance sufficient to permit passage of a mooring line inwardly through said mouth between said finger means and the base into said line-retaining space, toward a closed position in which said mouth is relatively closed and said finger means is spaced from the base a distance less than the diameter of said line for blocking passage of the mooring line outwardly through the mouth, said mooring device further comprising a safety member movable between a closed position wherein it blocks passage of a line inwardly through said mouth and an open position wherein it does not block passage of the line inwardly through the mouth.

2. A mooring device as set forth in claim 1 wherein said arm has an outer free end portion flaring upwardly and ouwardly from the mouth for guiding said line into said mouth.

3. A mooring device as set forth in claim 2 wherein said finger means is attached to said outer free end portion of the arm, said finger means extending toward the base generally parallel to the outer free end portion of the arm.

4. A mooring device comprising a base, means for fastening the base to a surface, such as the surface of a dock or boat deck, and an arm on the base extending up from the base generally adjacent one end of the base and converging toward the opposite end of the base thereby to define, in conjunction with the base, a space for retaining a mooring line, said arm converging toward the base to a point where it is relatively closely spaced to the base thereby to form a mouth through which a mooring line may be passed inwardly into said line-retaining space, finger means on the arm adjacent said mouth inclined downwardly and inwardly toward said line-retaining space, said arm being spring biased from an open position in which said mouth is relatively wide open and said finger means is spaced from the base a distance sufficient to permit passage of a mooring line inwardly through said mouth between said finger means and the base into said line-retaining space, toward a closed position in which said mouth is relatively closed and said finger means is spaced from the base a distance less than the diameter of said line for blocking passage of the mooring line outwardly through the mouth, said arm ahving an outer free end portion flaring upwardly and outwardly from the mouth for guiding said line into said mouth, said mooring device further comprising a safety member pivotably connected to the outer free end portion of the arm, the safety member being pivotable from a closed position wherein it blocks passage of a line inwardly through said mouth, to an open position to permit passage of said line inwardly through the mouth.

5. A mooring device comprising a base, means for fastening the base to a surface, such as the surface of a dock or boat deck, and an arm on the base extending up from the base generally adjacent one end of the base and converging toward the opposite end of the base thereby to define, in conjunction with the base, a space for retaining a mooring line, said arm converging toward the base to a point where it is relatively closely spaced to the base thereby to form a mouth through which a mooring line may be passed inwardly into said line-retaining space, finger means on the arm adjacent said mouth inclined downwardly and inwardly toward said line-retaining space, said arm being spring biased from an open position in which said mouth is relatively wide open and said finger means is spaced from the base a distance sufficient to permit passage of a mooring line inwardly through said mouth between said finger means and the base into said line-retaining space, toward a closed position in which said mouth is relatively closed and said finger means is spaced from the base a distance less than the diameter of said line for blocking passage of the mooring line outwardly through the mouth, said base comprising two generally parallel spaced-apart legs and said arm comprising two generally parallel spaced-apart arm members integrally formed with the legs, said finger means comprising a finger extending from the arm members and having a free end receivable between the legs when the arm is in its closed position.

6. A mooring device as set forth in claim 5 wherein said mooring device is formed from metal wire bent to form said base and arm, said finger being formed of metal wire.

7. A mooring device as set forth in claim 6 wherein the finger has a diameter slightly less than the space between the legs.

8. A mooring device as set forth in claim 5 wherein the free end of the finger is configured to facilitate pulling the mooring line inwardly past the finger.

9. A mooring device as set forth in claim 5 wherein said arm has an outer free end portion flaring upwardly and outwardly from the mouth for guiding said line into said mouth.

10. A mooring device as set forth in claim 9 further comprising a safety member pivotably connected to the outer free end portion of the arm, the safety member being pivotable from a closed position wherein it blocks passage of a line inwardly through said mouth, to an open position to permit passage of said line inwardly through the mouth.

11. A mooring device as set forth in claim 9 wherein said finger is attached to said outer free end portion of the arm, the finger extending from between the arm members toward the base generally parallel to the outer free end portion of the arm.

12. A mooring device as set forth in claim 5 wherein said means for fastening the base to a surface comprises a cylindrical member adapted to be fastened to the surface and having a circumferential groove therein, said base having portions received in said groove thereby to secure the base to said cylindrical member.

13. A mooring device as set forth in claim 1 wherein said base has a recess therein adjacent said opposite end of the base for receiving said finger means.

14. A mooring device as set forth in claim 13 wherein said arm comprises two arm members bent to form, in conjunction with the base, said line-retaining space.

15. A mooring device as set forth in claim 14 wherein each arm member is generally J-shaped as viewed from a respective side of the base.

16. A mooring device as set forth in claim 15 wherein said arm has an outer free end portion flaring upwardly and outwardly from the mouth for guiding said line into said mouth.

17. A mooring device comprising a base, means for fastening the base to a surface, such as the surface of a dock or boat deck, and an arm on the base extending up from the base generally adjacent one end of the base and converging toward the opposite end of the base thereby to define, in conjunction with the base, a space for retaining a mooring line, said arm converging toward the base to a point where it is relatively closely spaced to the base thereby to form a mouth through which a mooring line may be passed inwardly into said line-retaining space, finger means on the arm adjacent said mouth inclined downwardly and inwardly toward said line-retaining space, said arm being spring biased from an open position in which said mouth is relatively wide open and said finger means is spaced from the base a distance sufficient to permit passage of a mooring line inwardly through said mouth between said retaining member and the base into said line-retaining space, toward a closed position in which said mouth is relatively closed and said finger means is spaced from the base a distance less than the diameter of said line for blocking passage of the mooring line outwardly through the mouth, said base having a recess therein adjacent said opposite end of the base for receiving said finger means, said arm comprising two arm members bent to form, in conjunction with the base, said line-retaining space, each arm member being generally J-shaped as viewed from a respective side of the base, said arm having an outer free end portion flaring upwardly and outwardly from the mouth for guiding said line into said mouth, said mooring device further comprising a safety member pivotably connected to the other free end portion of the arm, the safety member being pivotable from a closed position wherein it blocks passage of a line inwardly through said mouth, to an open position to permit passage of said line inwardly through the mouth.

18. A mooring device as set forth in claim 17 wherein said finger means is attached to said outer free end portion of the arm and extends toward the base generally parallel to the outer free end portion of the arm.

* * * * *